US005921844A

United States Patent [19]

Hollick

[11] Patent Number: 5,921,844

[45] Date of Patent: Jul. 13, 1999

[54] TOY CADDY

[76] Inventor: Michael F. Hollick, Legassie Trailer Park Box B4 R.R. #1, Callender, On., Canada, P0H 1H0

[21] Appl. No.: 08/951,043

[22] Filed: Oct. 15, 1997

[51] Int. Cl.[6] ..... A63H 7/04

[52] U.S. Cl. ..... 446/450; 446/451; 446/73; 446/268; 446/269; 280/47.17

[58] Field of Search ..... 446/450, 451, 446/452, 73, 78, 95, 96, 102, 174, 227, 272, 275, 427, 436, 453, 124, 268, 269; 46/23, 220; 280/47.17, 23.1, 47.25, 472, 107, 46, 823

[56] References Cited

U.S. PATENT DOCUMENTS 2,446,770 8/1948 Kershisnik ..... 446/96
3,175,328 3/1965 Tricarico ..... 446/452
3,361,439 1/1968 Olson ..... 280/43.1

*Primary Examiner*—Robert A. Hafer
*Assistant Examiner*—Jeffrey D. Carlson
*Attorney, Agent, or Firm*—D. W. Eggins

[57] ABSTRACT

A lightweight slender, elongated toy caddy, comprising a central shaft, having a substantially axially extending removable handle located at its upper end; replaceable ground-contact means at the shaft lower end comprise a wheel, or dual wheels or a ski. A moveable seat is located intermediately upon the shaft. The wheels or ski require no tools in order to effect a change-over. The removable toy handle facilitates shortening of the shaft, to better suit the toy to the size of the user. The seat of the toy includes a seat belt for use in securing a toy, such as a stuffed animal or a doll and to serve as a teaching tool, to teach the need to buckle-up, as in a car seat. The toy is a uni-sex item, suitable for a wide age range of girls and boys. A handle loop or loops facilitates easy storage, and encourages tidyness.

12 Claims, 1 Drawing Sheet

42
44

18
20

28
16
30
32
36
18
12
20
34
10
4
14
22
26
24

28
30
36
38
40
14

50
52
56
54

TOY CADDY

BACKGROUND OF THE INVENTION

1. Field of the Invention

The present invention is directed to a child's toy, and in particular to a uni-sex, light-weight all-season activity toy adaptable to a wide age-range of girls and boys.

2. Description of the Prior Art

There has been an extremely wide range of wheelable toys provided for children in the past. With the exclusion of riding toys, theme prior art wheelable toys have tended to be particularly oriented to one or other of the sexes, with particular emphesis on prams and push-chairs for use by girls, and wagons for boys. Most of these prior art toys include the characteristic of requiring considerable storage space, and of constituting somewhat of a safety hazard, underfoot; alga, of being prone to damage when stepped upon.

SUMMARY OF THE INVENTION

The present invention provides a slender, elongated wheelable toy, comprising a central shaft, having a substantially axially extending handle located at the upper end thereof; ground-contact means located oppositely thereto; and seat means located upon the shaft intermediate the handle and the ground-contact means. The ground contact means may be readily replaceable by hand, without requiring tools, and may comprise a wheel, or dual wheels or a ski.

The toy handle may be removable, and the shaft readily shortened, whereby, in use, upon shortening the shaft to a desired length the handle can be replaced, and the toy restored, at a length beat suited to the height of the user, the toy being suited to a wide age range of two to ten years. The toy wheel means may comprise a centrally located single wheel, or a pair of wheels in close-spaced relation, having the shaft located therebetween.

The removable ski may be pivotally attached to the lower end of the handle.

The toy seat means may be moveably secured to the shaft, to enable longitudinal adjustment of the seat means along the shafts. The seat may include a seat belt for use in securing a toy, such as a stuffed animal, a doll, or even a pet animal in the seat means. This can serve as a useful teaching tool, to readily teach very young children the need, value and importance of "buckling up", as in a car seat, especially if the toy or pet falls out of the seat.

The toy handle may include suspension loop means, whereby the toy may be readily suspended from a supporting hook. This again can constitute a useful teaching tool, for teaching a child both tidiness, responsibility, eye/hand coordination and manual dexterity.

The toy handle loop means may comprise an elongated flexible loop, or a stiff molded loop for overhead use.

BRIEF DESCRIPTION OF THE DRAWINGS

Certain embodiments of the present invention are described by way of illustration, without limitation of the invention thereto other than as set forth in the accompanying claims, reference being made to the accompanying drawings, wherein;

DESCRIPTION OF THE PREFERRED EMBODIMENTS

Figures 1, 2, 3, 4, 5:
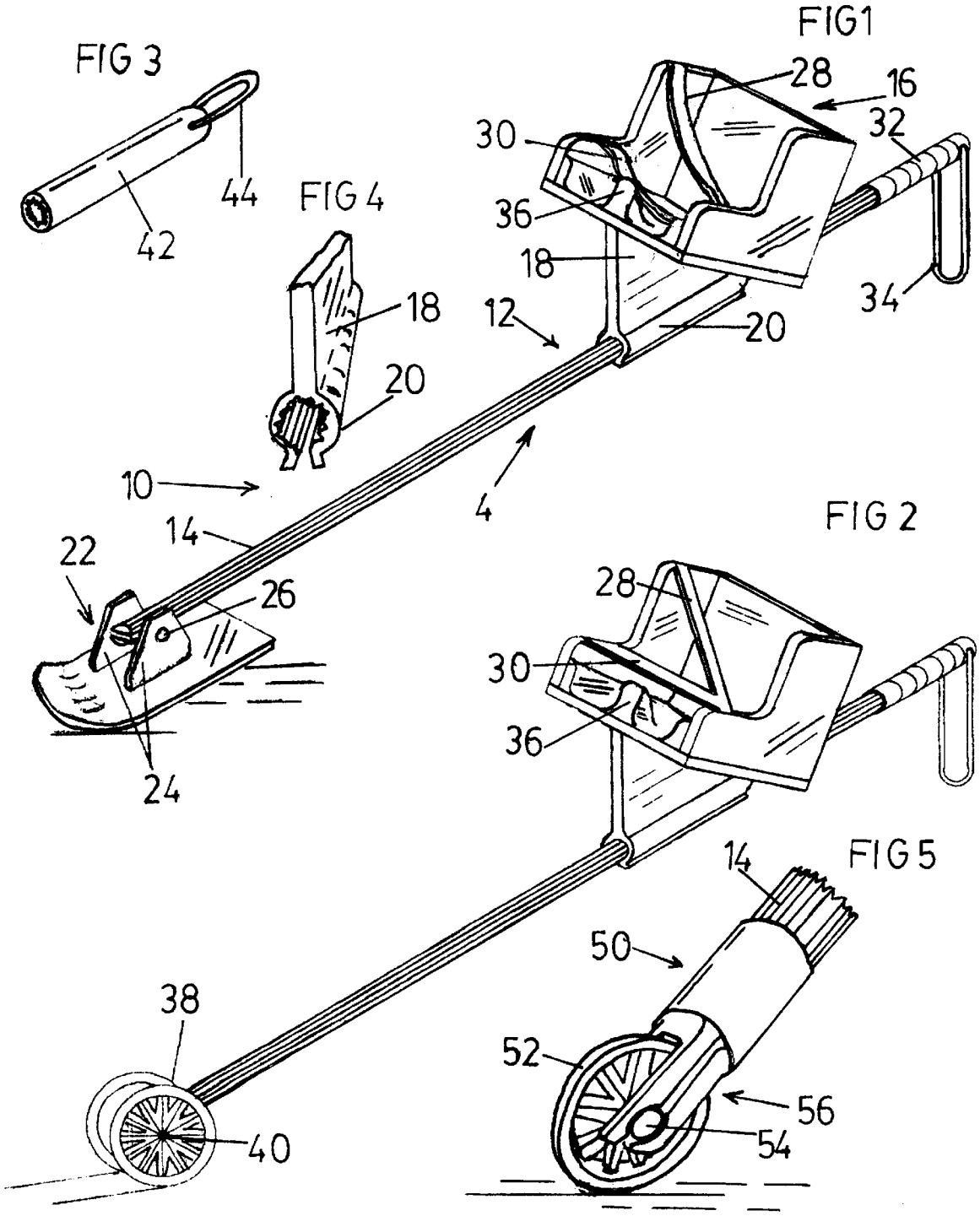
FIG. 1 is a frontal side perspective view of a toy in accordance with the present invention, in a ski guise.
FIG. 2 is a like perspective view of the toy in a wheeled guise.
FIG. 3 is a perspective view of a removable handle portion of the subject toy.
FIG. 4 is a frontal view of the seat mounting arrangement, taken in the direction of the arrow 4 in FIG. 1; and, FIG. 5 is a side perspective showing a detachable single wheel mounting arrangement.

Referring to FIGS. 1 and 2, the toy 10 has a central shaft 12, illustrated as having a multi-splined surface 14. A seat 16 equipped with back and sides is removably mounted on the shaft 12, being supported by an inclined flange 18. The flange 18 has a unitary bifurcated mounting boss 20, which frictionally and resiliently grips the shaft 12 (see also FIG. 4) permitting axial sliding displacement of the flange 18 along the shaft 12 when the bifurcation is spread apart, for relocation of the seat 16 upon the shaft 12, or removal from an end of shaft 12.

It will be understood that simpler shaft sections, other than the multi-splined section illustrated, may be used, such as rectangular or octagonal, etc., being preferably hollow sections, with consequent corresponding changes to the section of associated components.

For the FIG. 1 ski guise, a ski 22 having a pair of brackets 24 and pivot pin 26 is attached by the pin 26 to the bottom and of the shaft 12, which is bifurcated for ready attachment and removal purposes of both ski or wheels. Portions of a shoulder safety belt 28 and lap belt 30 are shown.

The seat 16 has a pommel portion 36 to better retain a toy occupant in the seat 16.

A slidably removable handle 32 has a flexible loop 34, by which the toy 10 may be hung from a hook, as in a closets The loop 34 is also of use to a child when tired of wheeling the toy 10, enabling trailing of the toy ;by its loop. Also, for an adult coping with a tired child, the lightweight toy 10 may be suspended by the loop from the adult's wrist. In the FIG. 2 wheeled guise, dual wheels 38 are shown, being removably secured by way of the wheel axle 40, which is clipped into the bifurcated end of the shaft 12, the bifurcation having an enlarged recess at its inner end, to receive and grip the axle 40 at its centre, in clipped relation.

In the cast of the FIG. 3 handle embodiment 42 the suspension loop 44 is moulded in resilient plastic, to facilitate hanging the toy 10 from an overhead hook. The simultaneous provision of both types of suspension loops 34 and 44 is contemplated.

In the FIG. 5 embodiment, a slide-on sleeve assembly 50, is provided for mounting upon the bottom end of shaft 12. The sleeve assembly 50 has a single wheel 52, removably mounted by means of its axle 54 between a pair of forks 56, each of which is bifurcated, with an enlarged recess at the inner end of each fork bifurcation, to grip the axle 54 in secured, retaining relation therewith.

The dual wheels 38 of the FIG. 2 embodiment may be mounted in straddled relation upon the forks 56, if required. The toy 10 can be moulded in plastic.

The shaft 12 can be readily shortened, by removing the handle, item 32 or 42 respectively, cutting off a desired length from the shaft 12, and reapplying the handle 32 or 42.

I claim:

1. A hand-operated mobile toy caddy, suitable for use by a small child, being of slender, light-weight, elongated construction and comprising a central shaft, having an axially extending handle located on the polar axis of said toy caddy at the upper end of the shaft, ground contact means located at the end of said shaft opposite said handle in symmetrical, close proximity relation with said polar axis the ground contact means being selected from the group consisting of a single, centrally located wheel, a pair of wheels centered about said shaft and immediately adjacent said shaft, and a single, centrally located ski; and seat means slideably located upon said shaft intermediate said handle and said ground contact means, in use to receive a second toy in seated relation therein, said central shaft having a cross-section shaped to preclude rotation of said seat means about said shaft.

2. The toy as set forth in claim 1, said handle being removable, and said shaft being readily shortenable by severance of an upper end portion thereof, whereby, in use, upon shortening of said shaft and replacement of said handle said toy is better suited to the user.

3. The toy, as set forth in claim 2, said ground contact means comprising a single wheel in symmetrically secured relation with said shaft.

4. The toy, as set forth in claim 2, said ground contact means comprising a pair of wheels centered about said shaft and immediately adjacent said shaft.

5. The toy as set forth in claim 1, said ground contact means comprising a single centrally located removable ski.

6. The toy as set forth in claim 1, said seat means being frictionally and slideably secured to said shaft, to enable longitudinal adjustment of the seat means axially along the shaft.

7. The toy an set forth in claim 6, said seat means including a seat belt for use in securing a toy figure within said seat means.

8. The toy as met forth in claim 1, said handle including suspension loop means, whereby said toy may be readily suspended from a supporting hook.

9. The toy as set forth in claim 8, said handle loop means comprising a flexible loop.

10. The toy as set forth in claim 8, said handle loop means comprising a substantially rigid loop, to facilitate attachment of said toy to an overhead point of support.

11. The toy as set forth in claim 1, the lower end of said shaft being bifurcated to a transverse recess in the shaft, to receive sa id ground contact means in inserted, resiliently retained, clipped relation in said recess.

12. The toy as set forth in claim 11, said transverse recess having a restricted mouth portion and an enlarged inner end, to retain an axle portion of said ground contact means secured in clipped relation within the recess.

* * * * *